US006675390B1

(12) United States Patent
Chang

(10) Patent No.: US 6,675,390 B1
(45) Date of Patent: Jan. 13, 2004

(54) SEAMLESS FRONT FLAP ASSEMBLY

(75) Inventor: Yung Sheng Chang, Taipei (TW)

(73) Assignee: J. Adams Associates Limited, Taipei (TW)

( * ) Notice: Subject to any disclaimer, the term of this patent is extended or adjusted under 35 U.S.C. 154(b) by 0 days.

(21) Appl. No.: 10/213,119

(22) Filed: Aug. 6, 2002

(51) Int. Cl.[7] ..... A41D 1/00
(52) U.S. Cl. ..... 2/96; 24/432
(58) Field of Search ..... 2/69, 77, 79, 80, 2/85, 87, 93, 96, 102, 106, 108, 115, 95, 121, 122, 275, 266, 243.1, DIG. 5; 24/389, 384, 432, 397, 398, 394; 112/418, 475.16, 441, 475.09, 406; 156/93; 428/53, 57, 58, 77, 411.1, 911

(56) References Cited

U.S. PATENT DOCUMENTS 2,148,269 A * 2/1939 Koch ..... 2/96
2,371,776 A * 3/1945 Van Orman ..... 2/96
3,090,047 A * 5/1963 De Grazia ..... 2/275
3,449,764 A * 6/1969 De Fazio et al. ..... 2/96
3,962,729 A * 6/1976 Cook ..... 2/234
4,628,545 A * 12/1986 Metzler ..... 2/96
5,159,719 A * 11/1992 Aumann ..... 2/87
5,444,898 A * 8/1995 Norvell ..... 24/389
5,529,823 A * 6/1996 Aumann ..... 428/53
6,223,349 B1 * 5/2001 Roiser ..... 2/82
6,571,432 B1 * 6/2003 Rindle ..... 24/432

* cited by examiner

*Primary Examiner*—Gloria M. Hale
(74) *Attorney, Agent, or Firm*—Ladas & Parry

(57) ABSTRACT

The seamless front flap assembly for a garment having a first front panel and a second front panel in a side-by-side relationship, the assembly comprising: an outer flap including an upper layer fabric extending from the first front panel of the garment, a lower layer fabric, and a compound sandwiched between the upper layer fabric and the lower layer fabric and for adhering the upper layer fabric to the lower layer fabric; an inner flap attached to the second front panel of the garment; and a zipper having a first zipper tape and a second zipper tape in a side-by-side relationship, each zipper tape having a tooth side and a free side, wherein the first zipper tape is located below the lower layer fabric of the outer flap with the free side of the first zipper tape being attached to the lower layer fabric of the outer flap; and the free side of the second zipper tape is attached to the second front panel of the garment, and wherein when the first and second zipper tapes are engaged together along the tooth sides thereof, the outer flap extends beyond where the inner flap and the second zipper tape are attached to the second front panel.

12 Claims, 3 Drawing Sheets

SEAMLESS FRONT FLAP ASSEMBLY

BACKGROUND OF THE INVENTION

1. Field of the Invention

The present invention relates to a seamless front flap assembly. Specifically, the present invention relates to a seamless front flap assembly for the front shell of a waterproof garment.

2. Description of the Related Art

FIGS. 1–3 show a conventional waterproof jacket. The jacket is made by stitching a plurality of the impregnated man-made shell fabrics together and has two opposite front panels. The front flap assembly for the jacket is constructed by first stitching an outer flap and an inner flap respectively with each of the front panels. A zipper tape is further located below the outer flap and stitched therewith, while the other zipper tape is located above the inner flap and stitched therewith. Based on the above structure, when the two zipper tapes are engaged to form a zipper, the outer flap and the inner flap enclose the zipper and the water will not pass through the zipper rendering the waterproof effect. However, as shown by the broken lines in FIG. 2, the water can still penetrate into the front panels through the needle holes of the stitching and the jacket cannot be 100% waterproof eventually.

To improve the above problem, for the shell fabrics, thermal tapes are provided under the stitching to ensure the waterproof effect. Since the thermal tape cannot be disposed at the front flap portion of the jacket for appearance reasons, instead of the stitching, the glue has been used to join the outer and inner flaps to the zipper tapes. However, the glued front flap portion usually has strong smell and the quality thereof is not stable. Further, the product output is low and the cost incurred is high. The above factors make the glued waterproof jacket have no competition in the market.

FIGS. 4–6 show the other conventional waterproof jacket that is widely used in the current outdoor waterproof jacket. In this instance, an outer flap is respectively stitched on each of the opposite front panels, with the upper one used to block the water and the lower one used as a gutter. A zipper tape is disposed below the respective outer flap and further stitched to the front panel. To prevent the water from penetrating into the needle holes of the stitching between the outer flap and the front panel, a thermal tape is provided under the stitching.

However, with two flaps on the top of the zipper, the jacket not only consumes more fabrics, the front of the jacket is also be stressed by the flaps and makes the wearer feel uncomfortable. Even though this type of jacket is waterproof, the front of the jacket is never clean and neat.

BRIEF SUMMARY OF THE INVENTION

An objective of the present invention is to provide a seamless front flap assembly for a garment, which is waterproof.

Another objective of the present invention is to provide a seamless front flap assembly for a garment, which makes the front of the garment look neat and elegant.

The other objective of the present invention is to provide a seamless front flap assembly for a garment, which can reduce fabric consumption.

To achieve these objectives, the seamless front flap assembly in accordance with the present invention for a garment having a first front panel and a second front panel in a side-by-side relationship, the assembly comprising: an outer flap including an upper layer fabric extending from the first front panel of the garment, a lower layer fabric, and a compound sandwiched between the upper layer fabric and the lower layer fabric and for adhering the upper layer fabric to the lower layer fabric; an inner flap attached to the second front panel of the garment; and a zipper having a first zipper tape and a second zipper tape in a side-by-side relationship, each zipper tape having a tooth side and a free side, wherein the first zipper tape is located below the lower layer fabric of the outer flap with the free side of the first zipper tape being attached to the lower layer fabric of the outer flap; and the free side of the second zipper tape is attached to the second front panel of the garment, and wherein when the first and second zipper tapes are engaged together along the tooth sides thereof, the outer flap extends beyond where the inner flap and the second zipper tape are attached to the second front panel.

The structure and objectives of the present invention can be more readily understood by persons skilled in the art from the following description of the preferred embodiments taken in conjunction with the accompanying drawings.

DETAILED DESCRIPTION OF THE INVENTION

Figure 1:
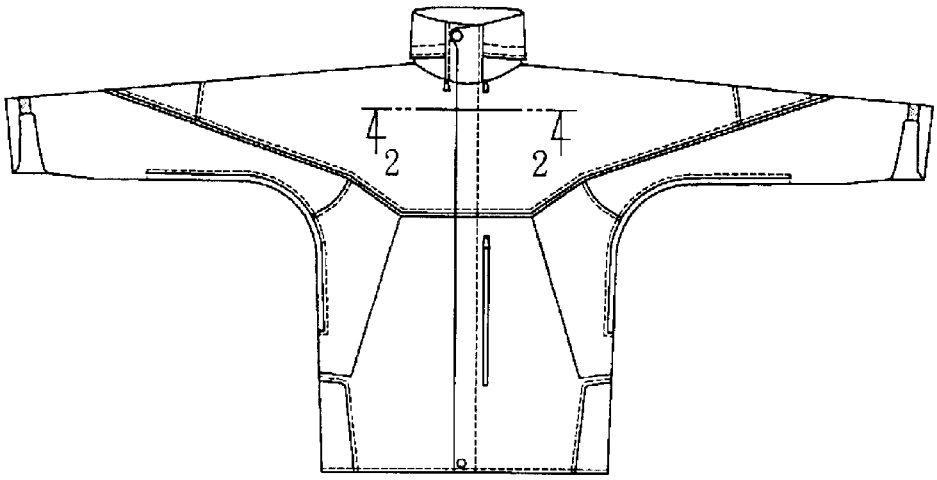
FIG. 1 (PRIOR ART)
FIG. 1 is a front elevational view of a conventional jacket.
Figure 2:
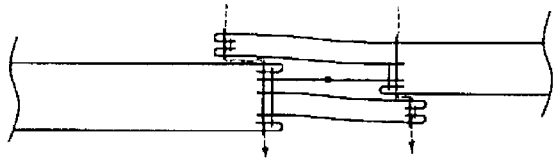
FIG. 2 (PRIOR ART)
FIG. 2 is a cross-sectional view taken along Lines 2—2 in FIG. 1.
Figure 3:
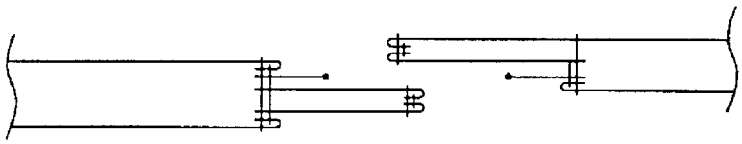
FIG. 3 (PRIOR ART)
FIG. 3 is a cross-sectional view of FIG. 2, wherein the jacket is in an open state.
Figure 4:
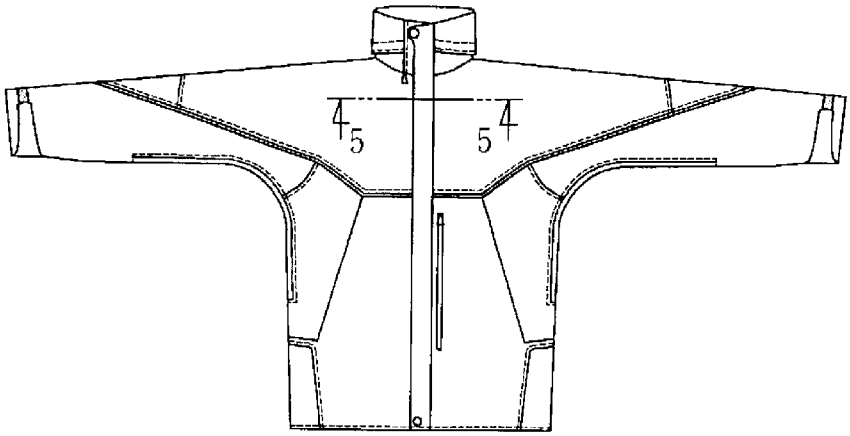
FIG. 4 (PRIOR ART)
FIG. 4 is a front elevational view of the other conventional jacket.
Figure 5:
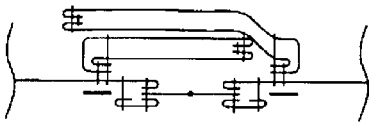
FIG. 5 (PRIOR ART)
FIG. 5 is a cross-sectional view taken along Lines 5—5 in FIG. 4.
Figure 6:
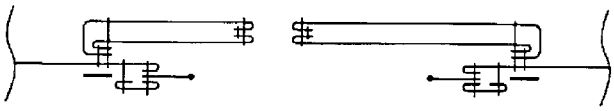
FIG. 6 (PRIOR ART)
FIG. 6 is a cross-sectional view of FIG. 5, wherein the jacket is in an open state.
Figure 7:
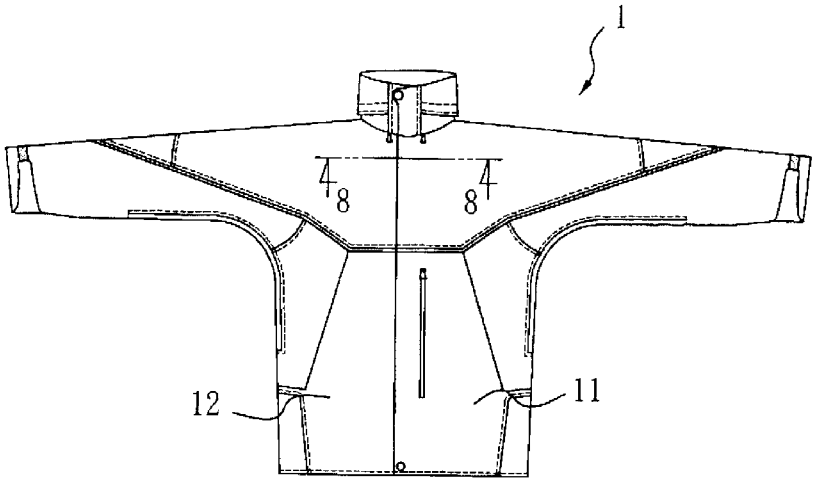
FIG. 7 is a front elevational view of a jacket in accordance with the present invention.
Figure 8:
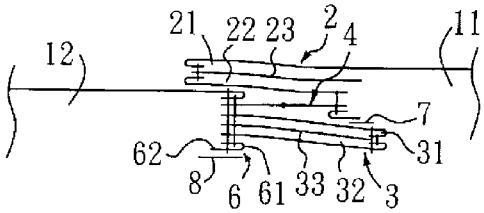
FIG. 8 is a cross-sectional view taken along Lines 8—8 in FIG. 7.
Figure 9:
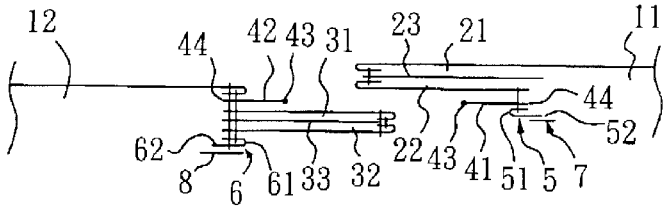
FIG. 9 is a cross-sectional view of FIG. 8, wherein the jacket is in an open state.

FIGS. 7–9 show the jacket with a seamless front flap assembly in accordance with a preferred embodiment of the present invention. As shown, the jacket 1 comprises a first front panel 11 and a second front panel 12 in a side-by-side relationship.

As best seen in FIG. 8, the seamless front flap assembly in accordance with the preferred embodiment of the present invention comprises an outer flap 2, an inner flap 3 and a zipper 4. The outer flap 2 includes an upper layer fabric 21 which extends from the first front panel 11, a lower layer fabric 22, and a thermal meltable compound 23 (for example, a polyurethane resin) sandwiched between the upper layer fabric 21 and the lower layer fabric 22.

The inner flap 3 includes an upper layer fabric 31, a lower layer fabric 32, and a thermal meltable compound 33 (for example, a polyurethane resin) sandwiched between the upper layer fabric 31 and the lower layer fabric 32.

The zipper 4 comprises a first zipper tape 41 and a second zipper tape 42. The first zipper tape 41 is disposed below the outer flap 2 and the second zipper tape 42 is, preferably, disposed above the inner flap 3. Each zipper tape 41, 42 has a tooth side 43 and a free side 44.

As shown in FIGS. 8 and 9, the front flap assembly in accordance with the preferred embodiment of the present invention may further comprise two backing layer fabrics 5 and 6 disposed over the jacket lining. The first backing layer fabric 5 is disposed below the first zipper tape 41 and has a first edge 51 and a second edge 52. The first edge 51 of the first backing layer fabric 5 is stitched to the free side 44 of the first zipper tape 41 and the lower layer fabric 22 of the outer flap 2. Further, the second edge 52 of the first backing layer fabric 5 is attached to the first front panel 11 of the jacket 1 by means of a thermal tape 7.

The second backing layer fabric 6 is disposed beneath the inner flap 31 and has a first edge 61 and a second edge 62. The first edge 61 of the second backing layer fabric 6 is stitched to the free side 44 of the second zipper tape 42, the inner flap 3 and the second front panel 12 of the jacket 1. Further, the second edge 62 of the second backing layer fabric 6 is attached to the second front panel 12 of the jacket 1 by means of a thermal tape 8.

Based on the above structure, by using a thermal welding machine to heat the thermal meltable compound 23, 33, and the thermal tapes 7, 8, the molten and then cured compound 23, 33 will adhere the upper layer fabrics 21, 31 to the lower layer fabrics 22, 32, while the molten and then cured thermal tapes 7, 8 will adhere the backing layer fabrics 5 and 6 to the lining of the front panels 21, 22. As such, the seamless front panel assembly in accordance with a preferred embodiment of the present invention is constructed.

When the tooth side 43 of the zipper tapes 41, 42 are engaged with each other, the outer flap 2, preferably, extends beyond where the inner flap 3 and the second zipper tape 42 are stitched to the second front panel 12 for covering up the needle holes of the stitching.

The inner flap 3 may also extend beyond where the first zipper tape 41 is stitched to the lower layer fabric 22 to further enhance the wafer-proof effects. As such, there will be no stitching found on the upper layer fabric 21 of the outer flap 2 and the front panels 11, 12, whereby no water can penetrate into the front panels 11, 12.

To further improve the waterproof effect, the first and second front panels 11, 12, the outer and inner flaps 2, 3, the first and second zipper tapes 41, 42, and the first and second backing layer fabrics 5, 6 may be made of impregnated fabrics, such as PU, PTFE, PVC, or rubber coated/laminated fabrics. However, it should be noted that while applying the present invention to other types of jackets, the shell fabrics for the jacket can also be non-impregnated, especially, highly breathable fabrics, which makes the jacket a fashionable collection with seamless neat outlook.

In addition, in accordance with the present invention, the jacket eliminates an extra piece fabric stressed on the front, which reduces the fabric consumption and makes the jacket look neat and elegant.

The structure of the present invention is not limited to the above embodiments. For example, the zipper can be replaced by the snap-on buttons, VELCRO™ hook and loop fasteners, etc. Although the invention has been described with reference to the preferred embodiments, it will be obvious to persons skilled in the art that various changes and modifications may be made without departing from the scope of the invention as recited in the claims.

| Sequence Listing | |
|---|---|
| 1 | jacket |
| 11 | first front panel |
| 12 | second front panel |
| 2 | outer flap |
| 21 | upper layer fabric |
| 22 | lower layer fabric |
| 23 | thermal meltable compound |
| 3 | inner flap |
| 31 | upper layer fabric |
| 32 | lower layer fabric |
| 33 | thermal meltable compound |
| 4 | zipper |
| 41 | first zipper tape |
| 42 | second zipper tape |
| 43 | tooth side of each zipper tape |
| 44 | free side of each zipper tape |
| 5 | first backing layer fabric |
| 51 | first edge |
| 52 | second edge |
| 6 | second backing layer fabric |
| 61 | first edge |
| 62 | second edge |
| 7 | thermal tape |
| 8 | thermal tape |

What is claimed is:

1. A seamless front flap assembly for a garment having a first front panel and a second front panel in a side-by-side relationship, the assembly comprising:

an outer flap including an upper layer fabric extending from the first front panel of the garment, a lower layer fabric, and a compound sandwiched between the upper layer fabric and the lower layer fabric and for adhering the upper layer fabric to the lower layer fabric;

an inner flap attached to the second front panel of the garment; and a zipper having a first zipper tape and a second zipper tape in a side-by-side relationship, each zipper tape having a tooth side and a free side, wherein the first zipper tape is located below the lower layer fabric of the outer flap with the free side of the first zipper tape being attached to the lower layer fabric of the outer flap; and the free side of the second zipper tape is attached to the second front panel of the garment, and wherein when the first and second zipper tapes are engaged together along the tooth sides thereof, the outer flap extends beyond where the inner flap and the second zipper tape are attached to the second front panel.

2. The seamless front panel assembly according to claim 1, wherein the second zipper tape is located above the inner flap.

3. The seamless front panel assembly according to claim 2, wherein when the first and second zipper tapes are engaged together along the tooth sides thereof, the inner flap extends beyond where the first zipper tape is attached to the lower layer fabric.

4. The seamless front panel assembly according to claim 3, wherein the inner flap has an upper layer fabric, a lower layer fabric, and a compound sandwiched between the upper layer fabric and the lower layer fabric for adhering the lower layer fabric to the upper layer fabric.

5. The seamless front panel assembly according to claim 4, wherein the compound is a thermal meltable polyurethane resin and adheres the upper layer fabric of the outer flap to the lower fabric layer of the outer flap, and the upper layer fabric of the inner flap to the lower fabric layer of the inner flap by heat.

6. The seamless front panel assembly according to claim 1, wherein the free side of the first zipper tape is attached to the lower layer fabric of the first front panel by stitching.

7. The seamless front panel assembly according to claim 1, wherein the free side of the second zipper tape and the inner flap are attached to the second front panel by stitching.

8. The seamless front panel assembly according to claim 1, further comprising a first backing layer fabric and a first thermal tape, wherein the first backing layer fabric is located below the first zipper tape and has a first edge and a second edge, the first edge of the first backing layer fabric being stitched to the first zipper tape, and wherein the first thermal tape adheres the second edge of the first backing layer fabric to the first front panel.

9. The seamless front panel assembly according to claim 8, further comprising a second backing layer fabric below the inner flap a second thermal tape, wherein the second backing layer fabric has a first edge and a second edge, the first edge of the second backing layer fabric being stitched to the second zipper tape, the inner flap and the second front panel, and wherein the second thermal tape adheres the second edge of the second backing layer fabric to the second front panel.

10. The seamless front panel assembly according to claim 9, wherein the first and second front panels and, the outer and inner flaps, the first and second zipper tapes, and the first and second backing layer fabrics are all impregnated woven fabric.

11. The seamless front panel assembly according to claim 9, wherein the first and second front panels, the outer and inner flaps, the first and second zipper tapes, and the first and second backing layer fabrics are non-impregnated woven fabric.

12. The seamless front panel assembly according to claim 5, wherein the thermal meltable polyurethane resin is heated by a thermal welding machine to result in adhesion effects.

* * * * *